US006050029A

United States Patent [19]

Simon et al.

[11] Patent Number: 6,050,029

[45] Date of Patent: Apr. 18, 2000

[54] CABLE-CONTROLLED WINDOW WINDER WITH A GUIDING TRACK

[75] Inventors: Hans-Georg Simon, Rattelsdorf; Franz Wagner, Lichtenfels, both of Germany

[73] Assignee: Brose Fahrzeugteile GmbH & Co. KB, Coburg, Coburg, Germany

[21] Appl. No.: 09/284,553

[22] PCT Filed: Dec. 23, 1997

[86] PCT No.: PCT/DE97/03035

§ 371 Date: Apr. 15, 1999

§ 102(e) Date: Apr. 15, 1999

[87] PCT Pub. No.: WO98/29632

PCT Pub. Date: Jul. 9, 1998

[30] Foreign Application Priority Data

Dec. 30, 1996 [DE] Germany ..... 196 54 851

[51] Int. Cl.[7] ..... E05F 11/48

[52] U.S. Cl. ..... 49/352

[58] Field of Search ..... 49/26, 28, 348, 49/349, 352, 374, 360

[56] References Cited

U.S. PATENT DOCUMENTS

| | | | |
|---|---|---|---|
| 4,759,653 | 7/1988 | Maekawa et al. | 49/352 X |
| 5,528,861 | 6/1996 | Beyerlein | 49/352 |
| 5,673,515 | 10/1997 | Weber et al. | 49/352 |
| 5,970,658 | 10/1999 | Smpth | 49/352 |

FOREIGN PATENT DOCUMENTS

| | | |
|---|---|---|
| 0701038 | 3/1996 | European Pat. Off. . |
| 2550267 | 2/1985 | France . |
| 3144496 | 7/1983 | Germany . |
| 4420008 | 5/1995 | Germany . |

*Primary Examiner*—Jerry Redman
*Attorney, Agent, or Firm*—Christie, Parker & Hale, LLP

[57] ABSTRACT

A cable window lifter for motor vehicles, with a guide rail, with a follower for a window pane which is mounted displaceable on the guide rail, and with a cable loop which is fixedly connected to the follower, in active connection with a drive unit, and is guided through guide pulley elements along the guide rail. The follower has a swivel mounted blocking element with a support area, preferably a support edge, which can be brought into positive locking engagement with a support element provided on the guide rail through swivel action of the follower. The support area of the follower associated with the support element is at a distance from the draw axis of the cable loop. The support element is mounted underneath the friction element. The window pane is in articulated connection with the follower.

18 Claims, 6 Drawing Sheets

10
11
1
20
29
22
23
31
14
18
16
30
12
27
6
21
13
17
15
Z
Fa
a
α
36
F 10
11
14
29
32
31
18
30'
16
d
Z
1
12
Fa
21
24
23
13
17
15
α
36
z
F
F2

CABLE-CONTROLLED WINDOW WINDER WITH A GUIDING TRACK

FIELD OF THE INVENTION

The invention relates to a cable window lifter with a guide rail.

BACKGROUND OF THE INVENTION

With window lifters of this kind, the window pane is fixed on one or two followers which are each guided on a guide rail and which can be displaced along the guide rail by means of a cable loop in active connection with a drive for raising and lowering the window.

From DE 31 44 496 C2, a window lifter of the generic kind is known which has a hand or motor driven displacement drive and which prevents automatic movement of the window pane when the displacement drive is stationary. This is achieved in that a brake device is attached to the follower, which when the displacement drive is stationary, presses a brake block against a side face of the guide rail. When the displacement drive is running, the guide rail is again released in that a resetting member mounted movable on the follower moves the brake block into a release position.

SUMMARY OF THE INVENTION

The object of the invention is to further develop a window lifter of the kind already mentioned so that a window can be held as securely as possible in the closed position or another defined position with the minimum structural expense.

This is achieved according to the invention through a cable window lifter for motor vehicles having a guide rail; a follower having a swivel mounted blocking element with a swivel axis; a cable loop which is guided along the guide rail; and a friction element of the follower that causes the swivel movement. The follower is mounted displaceable on the guide rail and is in connection with a window pane. The swivel axis of the blocking element runs across the extension direction of the guide rail. The cable loop is in active connection through guide pulley elements with a drive unit and transfers the drive force to the follower. The friction element is in active connection with the guide rail and is mounted outside of a draw axis of the cable loop.

The blocking element of the follower has a support area, preferably a support edge. This support area is movable from a first position spaced along the draw axis of the cable loop from a support element provided on the guide rail to a swiveled position that is in positive locking engagement with the support element provided on the guide rail through swivel action of the follower which is connected, for articulated movement, with the window pane. The support area of the follower is spaced from the support element along the draw axis of the cable loop. The support element is mounted underneath the friction element.

By friction element is meant a structural element which, during displacement of the follower along the guide rail, experiences a friction force.

With the design of a cable window lifter, according to the invention, the uncontrolled opening of a closed window through external forces which can occur, for example, when travelling over uneven roads or in the event of an unauthorized attempt to break into the vehicle, is prevented.

When an external force is exerted on the window pane which attempts to lower the window pane, a corresponding force also acts on the follower connected to the window pane. Because the swivel mounted follower is in friction connection with the guide rail or another locally fixed component part of the window lifter through a friction element, it does not simply follow the external force but it additionally executes a swivel movement about the axis which is defined by the friction element.

Because the friction element is preferably fixedly connected to the follower, it is not a question of a locally fixed swivel axis. Rather the friction element and, thus also, the swivel axis follow the movement of the follower (time-dependent momentary swivel axis).

As a result of its swivel movement, the follower, during lowering of the window pane, comes to a stop with the support element which is mounted at a suitable point in the area of the guide rail. A further lowering of the window pane is then avoided through the alternating (positive) engagement of the follower and support element.

With the proper opening of the window pane by means of the window lifter drive, the locking effect described above is prevented through suitable measures. The support element is mounted relative to the draw axis of the cable loop so that the cable loop during operation of the window lifter forms a force component which counteracts the swivelling of the follower.

Further measures exist in deactivating the support element during operation of the window lifter (e.g. through folding round) and/or in setting the friction force. The friction force acts in the area of the friction element so that this friction force in comparison with the draw forces, which act during operation of the window lifter, only represents a slight disturbance which is not sufficient to release the blocking of the follower during proper operation of the window lifter and tensioned cable loop.

The optimum size of the friction force compared with the draw force can be determined by experiment without problem for each type of window lifter. The friction force can thereby very simply be varied by using different friction elements and/or by changing the force with which the relevant friction element is supported on the guide rail or similar. Typical values for the friction force are at about 5 N; the tensile force of the cable loop amounts to about 400 N.

Insofar as the support element serves to hold the window pane as securely as possible in its closing position, the support element is mounted so that when the window pane is closed, it is located near the follower. The invention can however also be applied to secure other defined positions of a window pane.

The swivel movement of the follower takes place about an axis running transverse to the extension direction of the guide rail (guide direction of the follower). By this is meant, the axis of any swivel movement has at least one component at right angles to the extension direction of the guide rail.

The friction element is mounted outside of the straight line which runs parallel to the draw axis of the cable loop and runs through the engagement point of the pane forces on the follower. The engagement point of the pane forces is defined by the position of connecting (fixing) elements of the window pane and follower and, as a rule, lies on the draw axis itself. Through the arrangement described of the friction element, the direction of the swivel movement of the follower can be fixed by external forces and a reliable interaction with the support element can be ensured.

Furthermore, it is proposed to connect the friction element underneath the fixing (connecting) elements for the window pane with the follower.

The friction element can be, in particular, a constituent part of the follower, which is in frictional contact with the guide rail and which is thereby supported on a base surface of the guide rail which runs substantially parallel to the displacement plane of the window pane.

Furthermore, the friction element is preferably resilient and formed as an integral constituent part of the follower. The latter variation is particularly expedient for plastics followers. However the friction element can also be a separate structural element which is inserted in a suitable socket of the follower.

The support element with which the follower is to engage during swivel movement is mounted to secure the window pane in its closed position so that it is located, when the window pane is closed, underneath the section of the follower which can be brought into engagement with the support element. The phrase "mounted . . . underneath the . . . follower" is thereby to include any arrangement of the support element relative to the follower as a result of which the follower during opening of the window is moved along the guide rail to the support element.

The follower should, however, when the window pane is closed, not directly adjoin the support element but be preferably spaced from this along the draw axis of the cable loop at least by a small gap; for the rotary movement of the follower caused by the friction forces and producing the positive locking action takes place, as a rule, at the same time as the downward movement of the follower produced by the external forces. It is therefore possible that the follower then only concludes its swivel movement, which is required for locking, when it has already moved a little along the guide rail under the external force. When the window pane is closed, the distance between the follower and support element should however not be so great that the locking mechanism first engages when the window pane has already released a larger gap relative to the window frame. The distance between the follower and support element therefore preferably amounts to between 2 mm and 10 mm.

The support element is preferably mounted on a side arm of the guide rail.

A particularly simple design is produced if the support element is an integral constituent part of the guide rail. It can thereby be formed both by a projection and by a recess of the guide rail.

In order to block the follower, the support element can have a stop face which runs inclined to the draw axis of the cable loop. A support element formed substantially triangular is particularly suitable for this.

The said angle is selected so that on one hand, in the event of action of external forces, the stop face blocks the follower reliably in a predetermined position, and that on the other hand the window pane, where necessary, can be opened at any time by means of the window lifter drive and through the draw forces of the cable loop whereby the follower slides over the stop face.

When the cable loop is tensioned and the follower is extended along the draw axis, the support element preferably reaches, in the direction transverse to the draw axis of the cable loop, up to the follower. It thereby happens that the follower contacts the support element as it passes by. Depending on whether the lowering of the pane takes place through proper activation of the window lifter drive (thus with the draw force of the cable loop) or through external forces acting on the window pane, the follower either passes the support element or it swivels against its stop face whereby the window pane is locked in keyed engagement in its actual position.

BRIEF DESCRIPTION OF THE DRAWINGS

Further advantages of the invention will become apparent from the following explanation of various embodiments with reference to the drawings in which.

DETAILED DESCRIPTION OF THE PREFERRED EMBODIMENT

Figure 1:
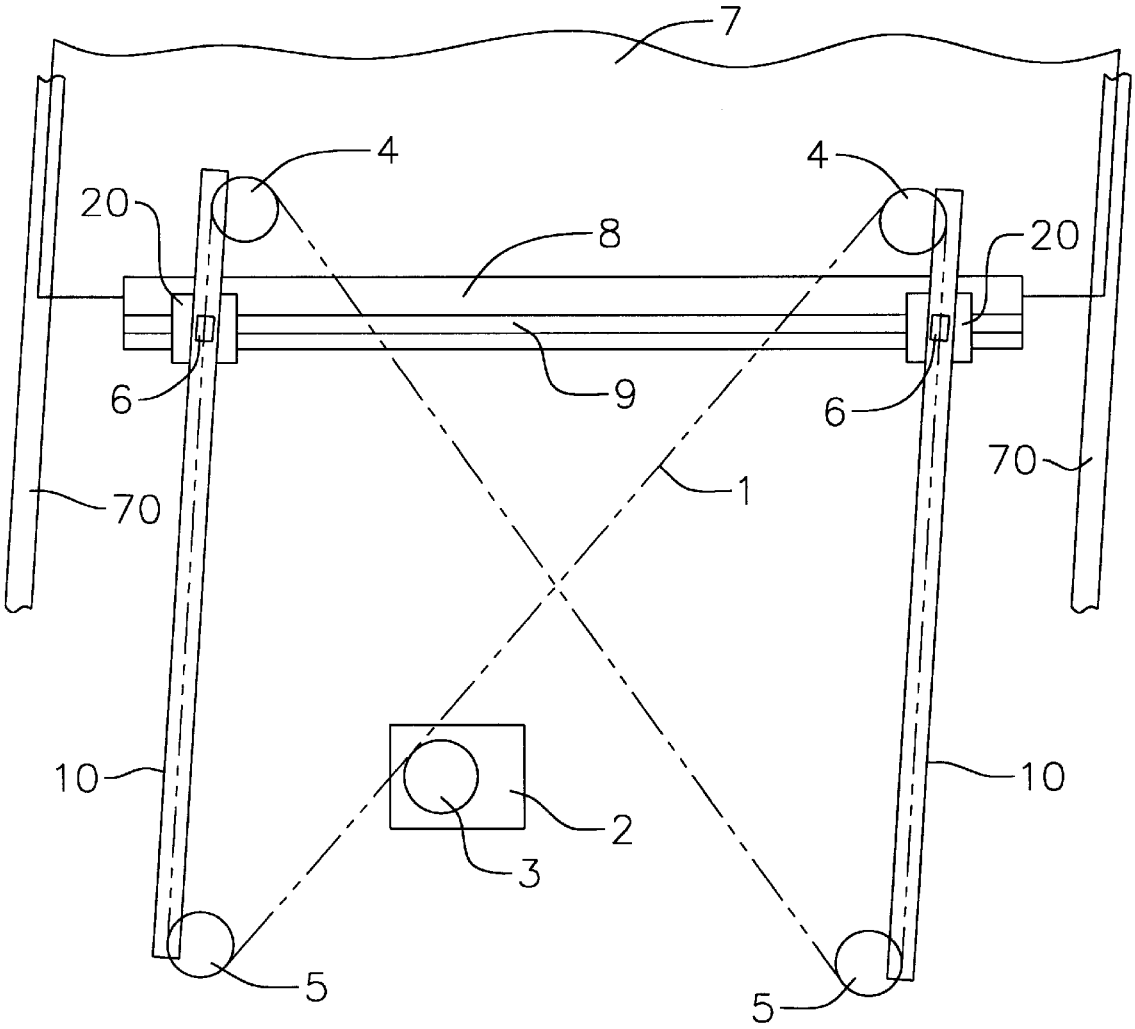
FIG. 1 is a principle sketch of a cable window lifter.

FIG. 1 shows diagrammatically the known construction of a cable window lifter.

A window pane 7 is connected on its lower edge to a profiled rail 8. A C-section 9 of the profiled rail engages the fastening elements of two followers 20. A cable pulley is associated with the followers 20 whereby a cable loop 1 which is in one piece or is composed of several cable sections is wound round a cable drum 3 of a drive unit 2 and is driven by means of an electric motor (not shown) or a crank. The cable loop 1 is guided through both an upper guide pulley 4 and a lower guide pulley 5 along the guide rails 10 of the two followers 20. It can hereby be proposed that the cable loop 1 is guided at least in part in a Bowden tube.

The followers 20 are mounted to slide in the guide rails 10 and are each connected by a cable nipple 6 to the cable loop 1 so that during activation of the drive unit 2 the followers 20 are moved along the guide rails 10 between the guide pulley elements 4, 5. Because the followers 20 are connected on the other side to the window pane 7 by the profiled rail 8, the window pane 7 is raised or lowered in side guides 70 corresponding to the operation of the drive unit 2.

FIGS. 2 to 4 each show an embodiment of the present invention which can be used with the cable window lifter described above and also with any other cable window lifters having a guide rail.

Figure 2A:
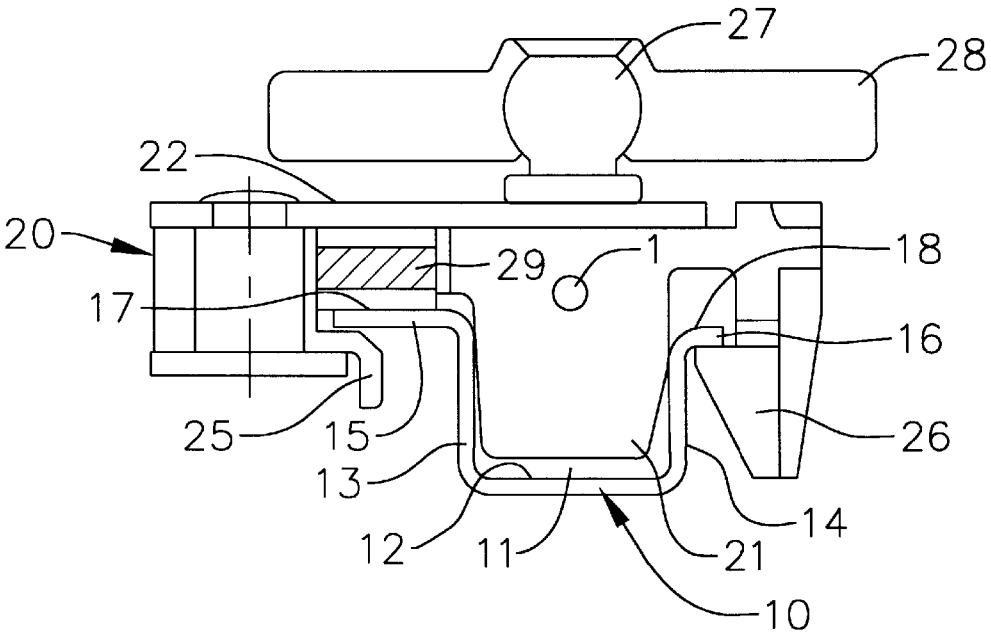
FIGS. 2*a* and 2*b* show a follower with a friction element which is guided in a profiled guide rail provided with a support element.
Figure 2B:
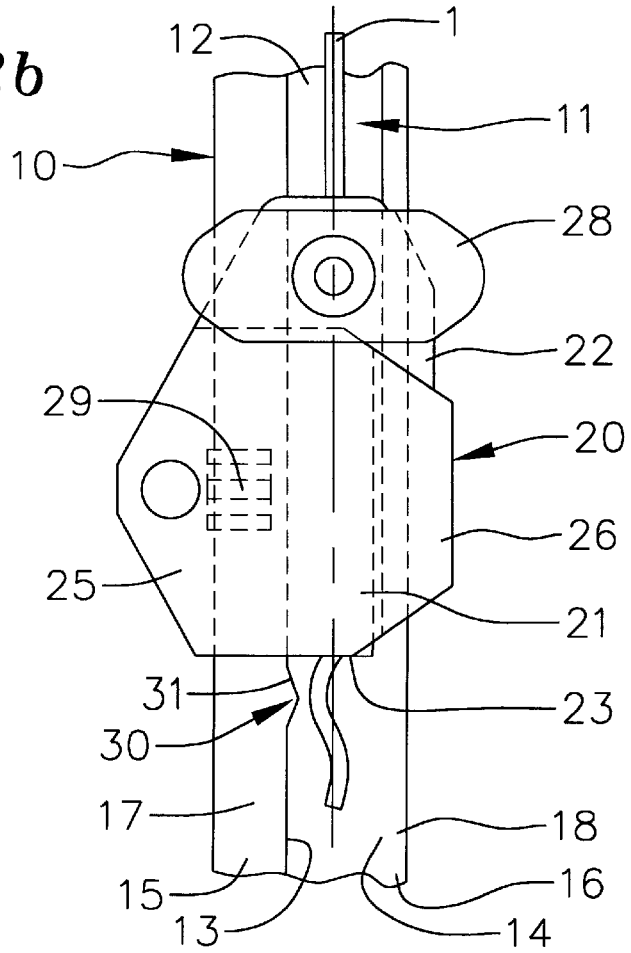

According to the cross-sectional illustration in FIG. 2*a* and the corresponding plan view in FIG. 2*b*, the cable window lifter comprises a profiled guide rail 10 and a follower 20 which is fixedly connected to a cable loop 1.

The guide rail 10 is formed hat-shaped in cross-section. It comprises a lower base surface 12 which runs substantially parallel to the plane of displacement of the window pane which is to be displaced (see FIG. 1). The guide rail is defined at the sides by two upwardly projecting arms 13, 14. Guide sections 15, 16 protrude out from the side arms 13, 14 and each define an upper base surface 17 and 18, respectively aligned parallel to the plane of displacement of the window pane.

The lower base surface 12 and the side arms 13, 14 form a guide channel 11 in which a stud 21 of the follower 20 engages. The follower 20 furthermore has, on both sides, hooked sections 25, 26. Each of the hooked sections engage round one of the guide sections 15, 16 of the guide rail 10. The hooked sections, together with the stud 21, provide a keyed connection between the follower 20 and the guide rail 10. The keyed connection is displaceable in the longitudinal direction of the rail.

The follower 20, furthermore, has on its side, remote from the guide rail 10, a flat surface support element 22 which in a known way can support fasteners for the window pane 7, and a stop for defining the displacement path and the like. Here the fasteners for the pane 7 comprise a plastics element 28, which on one side is connected with articulated movement to the follower 20 by a ball bearing (fastening point) 27 and on the other side is inserted in the C-section 9 of the profiled rail 8. This articulated connection of the window pane 7 with the follower 20 allows the follower 20 to swivel without the window pane 7 turning.

Figure 7B:
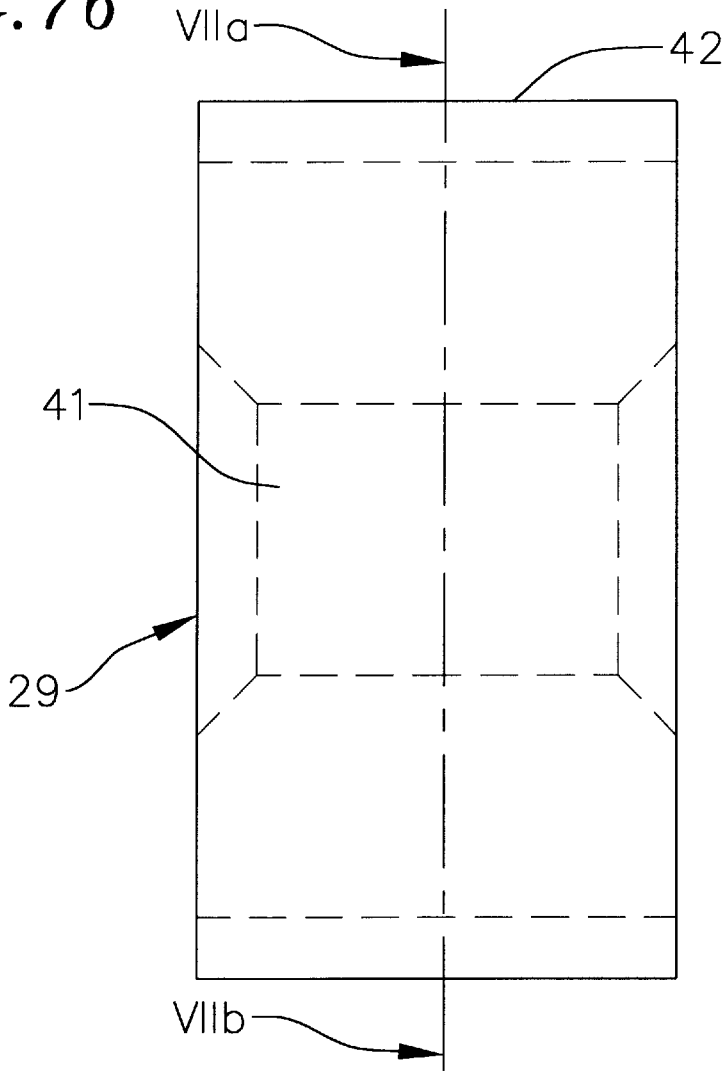
FIGS. 7*a* and 7*b* show a separate friction element which can be inserted into a follower.
Figure 7A:
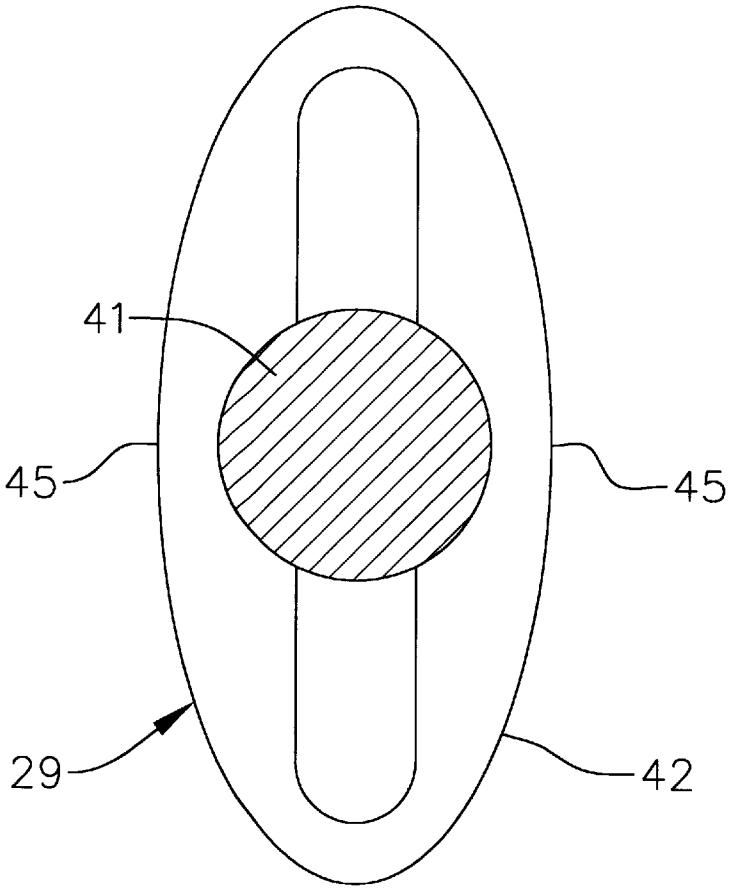

According to the invention, the follower 20 is additionally provided with a friction element 29 which is inserted in a socket (not shown in FIGS. 2*a*, 2*b*) of the follower 20 and which is mounted next to the draw axis z of the cable loop 1. The friction element 29, whose construction is shown in detail in FIG. 7*a* and 7*b* is in contact with the upper base surface 17 of the guide rail 10.

If an external force sufficient to cause lowering of the window pane 7 is exerted on the window 7, which is connected to the follower 20; e.g., when travelling over uneven roads, after accidental release of the brake of the window lifter or in the event of an attempt to open the window by force from outside the vehicle, then this force also acts on the follower 20 via the fastening point (ball bearing) 27. This entrainment member (the follower) is not only moved downwards along the guide rail 10, but also at the same time swivels about a swivel axis, which is formed by the friction element 29, and runs transversely to the upper base surface 17 of the guide rail 10.

It is thus not a fixed swivel axis but one which moves together with the follower 20 when the follower slides down along the guide rail 10 under the external force. Consequently, the position of the swivel axis is time-dependent (momentary axis), and depends on the external force exerted on the follower 20. In each case a swivel movement of the follower 20 is caused by the contact between the guide rail 10 and follower 20 through the friction element 29. The swivel movement thereby takes place in one plane which runs parallel to the base surfaces 12, 17 and 18 of the guide rail 10, i.e. the time-dependent swivel axis is aligned across this plane and thus across the plane of displacement of the window pane.

The swivel movement is thereby made possible in that both the stud 21 and the guide channel 11, and also the hooked sections 25, 26 and guide sections 15, 16, each engage in each other with sufficient play; i.e., the follower 20 is mounted in the guide rail 10 and able to swivel sufficiently.

As a result of the swivel movement described above, when the follower 20 is lowered, a surface area 23 of the stud 21 stops at a stop face 31 of a support element 30 formed on the side arm 14 of the guide rail 10. The surface area 23 is preferably a surface edge, a bottom underneath the stud. The follower 20 is thereby locked with keyed engagement in the guide rail 10, in that further lowering of the follower 10 and uncontrolled opening of the window pane which is connected to the follower, is prevented.

Lowering of the follower 20 by means of the cable loop 1 and by means of the associated drive unit of the window lifter (see FIG. 1) is possible as before, as will be described below with reference to FIGS. 3 and 4.

The construction of the guide rail 10 and the follower 20, in the case of the embodiment of the invention shown in plan view in FIGS. 3*a* to 3*c*, agrees with the embodiment explained with reference to FIGS. 2*a* and 2*b* except for some geometrical deviations.

The following explanations are therefore restricted to the illustration of further details on the function of the cable window lifter.

Figures 3A, 3B, 3C:
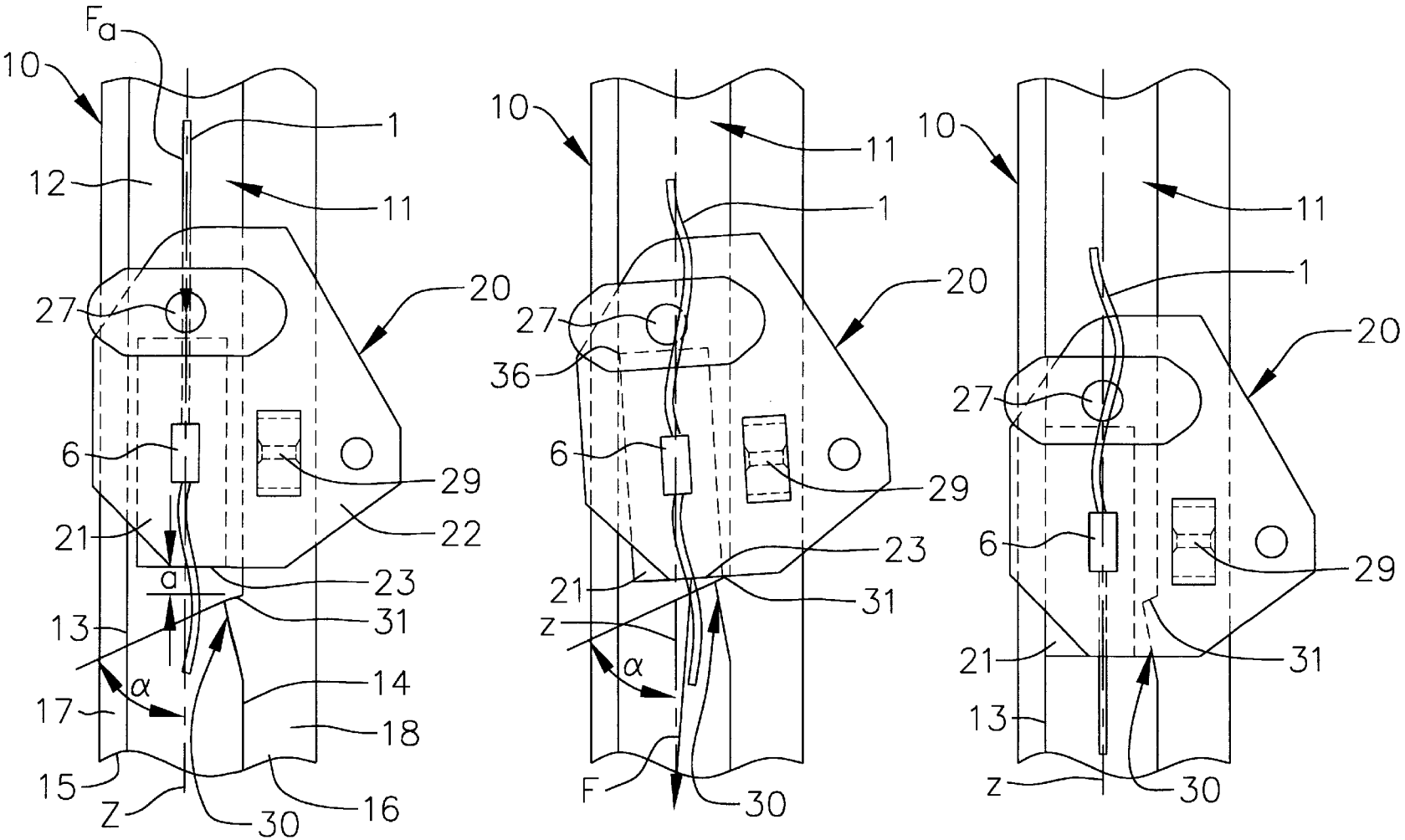
FIGS. 3*a* to 3*c* show a modification of the embodiment of FIG. 2 whereby the follower is shown in three different positions along the guide rail.

In FIG. 3*a* the follower 20 is located in its uppermost position in the guide rail 10; the associated window is closed accordingly. In this position, a support element 30 is formed along the extension direction of the guide rail 10, slightly spaced from the follower a distance a. The support element 30 is formed underneath the follower 20 on the side arm 14 of the guide rail 10. The support element further projects as a triangular projection into the guide channel 11.

It can furthermore be seen from FIG. 3*a* that the cable loop 1 is relaxed underneath the cable nipple 6 in the closed position of the window (with the drive switched off). If in this situation an external force $F_a$ is exerted on the window pane, which can occur for example when travelling over uneven roads, which acts through the fastening point 27 on the follower 20 resulting in lowering of the follower 20, then the follower 20 swivels about an axis lying transversely to the plane of displacement of the window pane. This axis is defined by the friction element 29 mounted next to the draw axis z of the cable loop 1.

As shown in FIG. 3*b*, as a result of this swivel movement the underneath 23 of the stud 21 travels, as the follower 20 drops down, to abut the stop face 31 of the support element 30. The stop face is inclined at an angle $\alpha$ of about 60° to the draw axis z of the cable loop 1. At the same time, the follower 20 is supported at position (support area) 36 above the support element 30 on the side arm 13 of the guide rail 10.

(The support area 36 is located on the side opposite the support element 30 of a plane running through the draw axis z of the cable loop 1 and at right angles to the plane of displacement of the window pane 7). Forces can be introduced into the support area 36 which are substantially opposite those forces acting in the area of the support element 30.

By blocking the follower 20 in this way it is prevented from dropping down further so that opening of the associated window is avoided. The follower 20 is locked in keyed engagement in the position shown in FIG. 3*b*.

Since the follower 20 is also supported by the upper end of its stud 21 on the side arm 13 of the guide rail 10 opposite the support element 30, the present locking mechanism is even self-locking relative to external forces $F_a$. If in this locked state of the window lifter, its drive is activated to open the window and to lower the window pane, then the draw force F shown in FIG. 3*b* acts on the follower 20. The draw force F engages next to the draw axis z on the follower 20. The engagement point of the cable loop 1 thereby lies on the same side as the support element 30, which is next to the plane running through the draw axis z and at right angles to the plane of displacement of the window pane 7. (In the present example the draw force F actually engages in the area of the cable nipple 6; for greater clarity the force arrow F is however shown in the area of the underneath 23 of the stud 21).

The force F comprises a component $F_2$ parallel to the draw axis z as well as a component $F_1$ transversely to same, whereby the latter causes the unlocking of the keyed connection. (Details for breaking down the draw force F into components are apparent from FIGS. 4*b* and *5*). The unlocking is due to the fact that the draw force F is much greater than the friction forces both in the area of the friction element 29, and in the area of the support element 30. The friction forces only represent a slight breakdown of the draw force F of the cable loop 1. The follower 20 can therefore be unlocked under the action of the force components $F_1$ (which act transverse to the draw axis z), whereby the follower is at first turned about the additional support area 36. The follower 20 is then drawn together with the friction element 29 along the guide rail 10 without the friction element 29 suffering any traceable resistance in view of the very large draw forces F (about 400 N).

FIG. 3*c* shows how the follower 20 moves downwards along the guide rail 10 through the action of the draw force F. On passing the support element 30, the follower 20 is slightly off-set towards the arm 13 of the guide rail 10 opposite the support element 30 in order to escape the support element. For as can be seen from FIG. 3*a*, the support element 30 projects somewhat further into the guide channel 11 than the distance of the follower 20 (with straight alignment along the draw axis z) from the side arm 14. Therefore the follower 20 contacts the support element 30 in each case in the event of moving downwards from its closed position illustrated in FIG. 3*a*.

Depending on whether the downward movement of the follower 20 takes place through external forces $F_a$ which act on the follower 20 above the friction element 29, or through draw forces F of the cable loop 1 which engage on the follower 20 underneath the friction element 29, the follower 20 does or does not swivel about the axis defined by the friction element 29. In the former case the follower 20 is locked with keyed engagement in its upper position; in the latter case the follower can escape the support element 30 (as explained with reference to FIG. 3*b*).

The guide channel 11 is slightly wider than the stud 21 of the follower 20 in the area of the support element 30, so that the stud can pass the support element 30 with slight play.

Figures 4A, 4B, 4C:
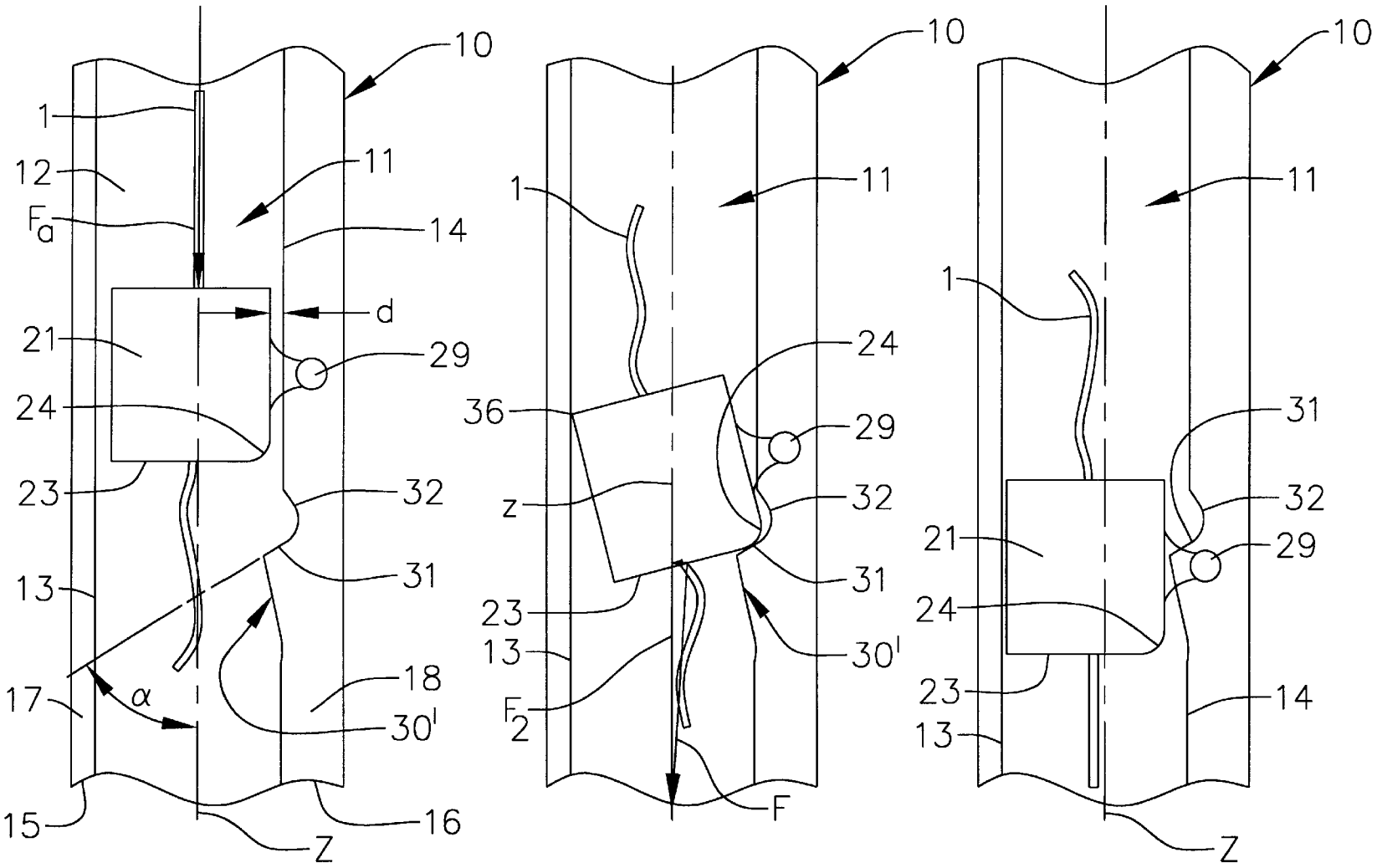
FIGS. 4*a* to 4*c* show a principle sketch of a further modification of the embodiment of FIG. 2.

FIGS. 4*a* to 4*c* show a modification of the embodiment illustrated in FIGS. 3*a* to 3*c*. For clarity of the follower 20, only the stud 21 mounted in the guide channel 11 and the direction (friction) element 29 are shown diagrammatically. The stud 21 thus forms here at the same time as the fixing element through which the follower is connected to the cable loop 1.

Two differences of the embodiment of FIGS. 4*a* to 4*c* from the embodiment shown in FIGS. 3*a* to 3*c* are as follows:

First, a support element 30' has here a recess 32 which is provided above the stop face 31 and into which a part of the stud 21 of the follower can swivel.

Second, formed at the bottom 23 of the stud 21 is an edge 24 facing the support element 30' so that this edge 24 during swivelling of the follower can project into the recess 32. The edge 24 is thereby rounded with a radius of curvature R which is of the same order as the distance d of the stud 21 from the side arm 14 of the guide rail 10 provided with the support element 30.

In the state according to FIG. 4*a*, the follower (here represented by the stud 21) is located in its uppermost position in the guide rail 10, i.e. the associated window is closed. If in this state an external force $F_a$ acts on the window pane and, thus, on the stud 21 which leads to an uncontrolled lowering of the pane, then the follower swivels together with the stud 21 about the friction element 29. The rounded edge 24 of the stud 21 thereby enters into the recess 32 of the side arm 14 of the guide rail 10. Simultaneously, the bottom 23 of the stud 21 abuts the stop face 31 of the support element 30' and an upper edge of the stud 21 adjoins at the position 36 on the side arm 13 of the guide rail. The follower and window pane are thereby held self-locking in their upper position, see FIG. 4*b*.

A secure locking of the pane through the swivel movement of the stud 21 is thereby also ensured in that according to FIG. 4*a*, the support element 30' projects across the extension direction of the guide rail 10 slightly further into the guide channel 11 than the distance d of the stud 21 from the side arm 14 provided with the support element 30'.

The stud 21 therefore contacts the support element 30' as the pane is lowered from its uppermost position. A slight swivel movement about the friction element 29 is then sufficient to make the desired positive locking action.

Figure 5:
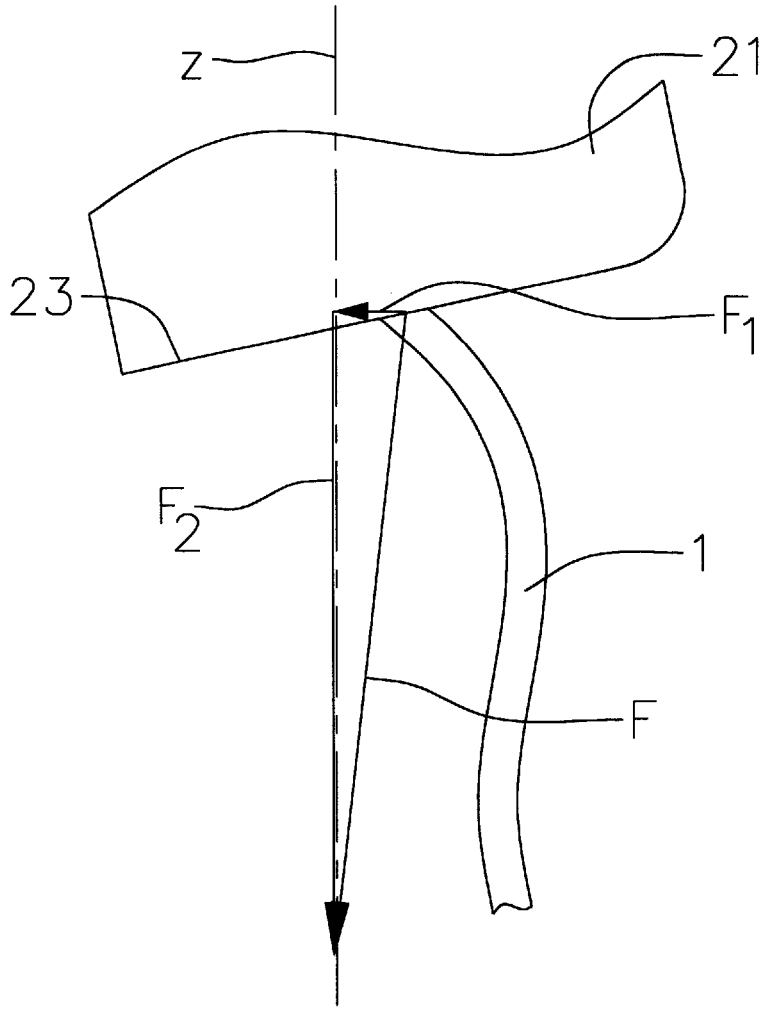
FIG. 5 shows an enlarged view of a cut-out section from FIG. 4*b;*

On the other hand, the stud 21—and with it the follower and the window pane fixed on the follower—can be lowered at any time in that a sufficiently large draw force F is applied to the cable loop 1 by means of the window lifter drive. See FIGS. 4*b* and 4*c*. The reasons for this have already been explained above with reference to FIGS. 3*b* and 3*c*. For an explanation of the draw force F acting in the area of the underneath 23 of the stud 21 with the components F1 and F2 reference is made to FIG. 5 which shows a cut-out section of FIG. 4*b*.

Figure 6:
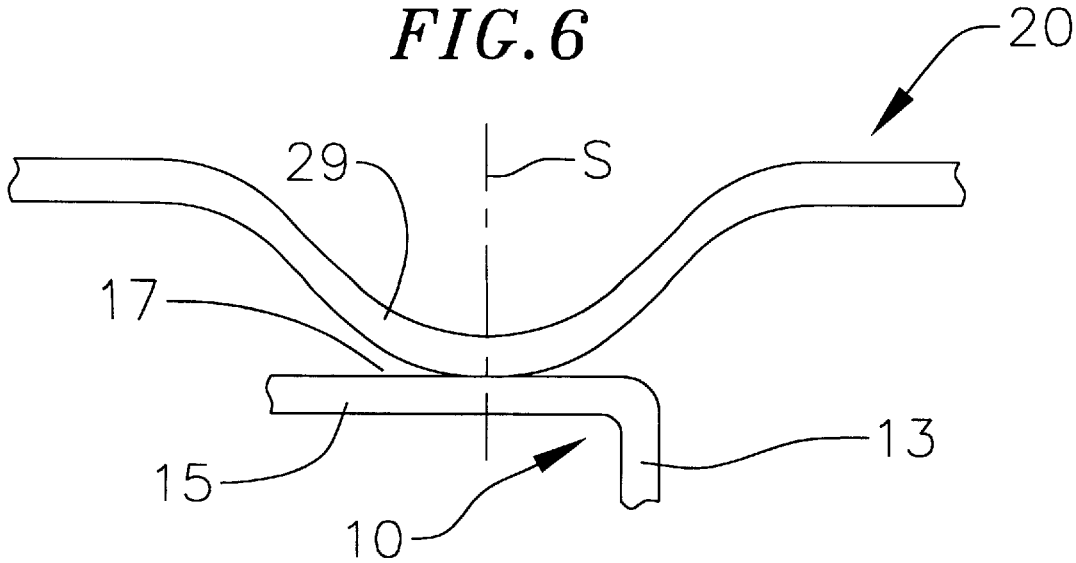
FIG. 6 shows a friction element integrated in one piece in a follower.

FIG. 6 shows a friction element 29 which is formed as a rounded projection integral on a follower 20. The friction element is in friction-locking spot contact with a base surface 17 of a guide rail 10 whereby a swivel axis s is formed.

FIGS. 7*a* and 7*b* show a friction element 29 which forms a separate component part which can be inserted in a suitable socket of a follower 20. A friction element 29 of this kind is provided for example in the embodiments of FIGS. 2 to 4.

The friction element 29 comprises an elastic oval sleeve 42 of, for example, metal in which a cylindrical structural element 41 of, for example, rubber is mounted which practically completely fills out the oval sleeve 42 transversely to its longitudinal extension.

This friction element 29 is inserted in a follower 20 so that one of the bulging sections 45 of the sleeve 42 is in friction locking contact with a base surface of the associated guide rail 10.

Both with the embodiment according to FIG. 6 and with the example according to FIG. 7 the friction element 29 can, through its friction-locking contact with the guide rail 10, each time form an axis about which the follower 20 is able to swivel.

We claim:

1. A cable window lifter for motor vehicles comprising:

a guide rail;

a follower having a swivel mounted blocking element with a swivel axis, which is mounted displaceable on the guide rail and is in connection with a window pane;

a cable loop which is guided along the guide rail, is in active connection through guide pulley elements with a drive unit and that transfers the drive force to the follower; and a friction element of the follower that causes the swivel movement and is in active connection with the guide rail;

wherein the swivel axis of the blocking element runs across the extension direction of the guide rail, wherein the friction element is mounted outside of a draw axis of the cable loop;

wherein the blocking element of the follower has a support area that is movable from a first position spaced along the draw axis of the cable loop from a support element provided on the guide rail to a swiveled position that is in positive locking engagement with the support element provided on the guide rail through swivel action of the follower;

wherein the support element is mounted underneath the friction element; and wherein the window pane is in articulated connection with the follower.

2. The cable window lifter according to claim 1 wherein the friction element is in contact with a base surface of the guide rail which runs substantially parallel to the plane of displacement of the window pane.

3. The cable window lifter according to claim 1 wherein the friction element is formed resilient.

4. The cable window lifter according to claim 1 wherein the friction element is an integral constituent part of the follower.

5. The cable window lifter according to claim 1 wherein the friction element is a separate constituent part of the follower.

6. The cable window lifter according to claim 1 wherein the support element, when the window pane is closed, is located underneath a support face of the followers; wherein the support face is associated with the support element and can be brought into engagement with the support element when the follower is swivelled.

7. The cable window lifter according to claim 1 wherein the distance along the draw axis of the cable loop is between 2 mm and 10 mm.

8. The cable window lifter according to claim 1 wherein the support element is mounted on a side arm of the guide rail.

9. The cable window lifter according to claim 1 wherein the support element is a constituent part of the guide rail.

10. The cable window lifter according to claim 9 wherein the support element is formed at least in part by a projection of the guide rail.

11. The cable window lifter according to claim 9 wherein the support element is formed at least in part by a recess of the guide rail.

12. The cable window lifter according to claim 1 wherein the support element has a stop face for the follower which runs inclined to the draw axis of the cable loop.

13. The cable window lifter according to claim 1 wherein the support element has a substantially triangular shape.

14. The cable window lifter according to claim 1 wherein the support element reaches up to the follower, in a direction transverse to the draw axis, with straight alignment of the follower along the draw axis of the cable loop.

15. The cable window lifter according to claim 1 wherein the support area is a support edge.

16. The cable window lifter according to claim 1 wherein the support element is an integral part of the guide rail.

17. The cable window lifter according to claim 1 wherein the support element is formed at least in part by a projection of the guide rail.

18. The cable window lifter according to claim 16 wherein the support element is formed at least in part by a recess of the guide rail.

* * * * *

UNITED STATES PATENT AND TRADEMARK OFFICE

CERTIFICATE OF CORRECTION

PATENT NO. : 6,050,029
DATED : April 18, 2000
INVENTOR(S) : Hans-George Simon and Franz Wagner It is certified that error appears in the above-identified patent and that said Letters Patent is hereby corrected as shown below:

Column 10,
Line 23, delete "claim 1" and insert therefor -- claim 16 --.

Signed and Sealed this

Twenty-fifth Day of June, 2002

*Attest:*

*Attesting Officer*

JAMES E. ROGAN
*Director of the United States Patent and Trademark Office*